US007103936B1

(12) United States Patent
Brandon

(10) Patent No.: US 7,103,936 B1
(45) Date of Patent: Sep. 12, 2006

(54) SCRAPER

(75) Inventor: L. D. Brandon, 1313 David Dr., Choctaw, OK (US) 73020

(73) Assignee: L. D. Brandon, Choctaw, OK (US)

( * ) Notice: Subject to any disclaimer, the term of this patent is extended or adjusted under 35 U.S.C. 154(b) by 339 days.

(21) Appl. No.: 10/411,763

(22) Filed: Apr. 11, 2003

(51) Int. Cl.
*A47L 13/02* (2006.01)
*A47L 13/08* (2006.01)

(52) U.S. Cl. ..... 15/236.06; 15/236.05; 30/172; D32/46; D32/48; D4/118

(58) Field of Classification Search ..... 15/236.05, 15/236.06, 236.09, 236.01; 30/169, 172; D32/46, 48; D4/118
See application file for complete search history.

(56) References Cited

U.S. PATENT DOCUMENTS

| | | | | |
|---|---|---|---|---|
| 785,556 | A | 3/1905 | Kent | |
| 878,293 | A | 2/1908 | Kadan | |
| 1,442,544 | A | 1/1923 | Schwenke | |
| 2,236,093 | A * | 3/1941 | Friend | 30/172 |
| 2,318,585 | A * | 5/1943 | Abrahamsen | 30/171 |
| 2,519,645 | A | 8/1950 | Gilbert | |
| 2,846,764 | A | 8/1958 | Hyneman | |
| 2,907,106 | A | 10/1959 | Lockwood | |
| 3,138,867 | A | 6/1964 | Harrison | |
| 3,675,266 | A | 7/1972 | Murray et al. | |
| 3,840,933 | A | 10/1974 | Schwab et al. | |
| 3,848,289 | A | 11/1974 | Bachmann | |
| 3,983,943 | A * | 10/1976 | van der Lely | 172/47 |
| 4,114,267 | A | 9/1978 | Marchio et al. | |
| 4,194,780 | A | 3/1980 | Dilley | |
| 4,490,879 | A | 1/1985 | Colby | |
| 4,497,114 | A | 2/1985 | Belcher | |
| 4,574,417 | A | 3/1986 | Magnasco | |
| D307,206 | S * | 4/1990 | Boyd | D32/46 |
| 4,984,324 | A * | 1/1991 | Farris | 15/236.05 |
| 5,049,109 | A | 9/1991 | Radovic et al. | |
| 5,263,222 | A | 11/1993 | Johnstone, II | |
| 6,018,836 | A * | 2/2000 | Williams | 15/111 |
| D453,251 | S | 1/2002 | Gringer et al. | |
| 2002/0095737 | A1 * | 7/2002 | Panfili et al. | 15/236.06 |

* cited by examiner

*Primary Examiner*—Gary K. Graham

(57) ABSTRACT

A wood scraper having two oppositely angled blades on a single head, and preferably two heads with two oppositely angled blades on each head. Thus, on both the forward and reverse stroke, there are two spaced apart blades scraping the work piece. This covers twice the surface area with the same effort as a single-bladed or single-headed scraper. All the blades are rigid and have a straight edge. All the blade edges are aligned with the planar surface of the work piece. This produces a level cut and makes the tool more stable, making gouging unlikely and enhancing the efficiency of the scraping action. The tool can be operated easily with one hand. In addition, the use of straight blades allows all the blades to be sharpened easily and quickly and at the same time using a belt sander or on a sheet of emery paper on a flat surface.

7 Claims, 3 Drawing Sheets

SCRAPER

FIELD OF THE INVENTION

The present invention relates to tools for scraping wood and other surfaces for the removal of paint or other coatings.

BACKGROUND OF THE INVENTION

Preparing a painted wood surface for refinishing or repainting remains a labor intensive task. Typically, a scraper is used to manually remove the old paint or other finish, then the surface is sanded and repainted. While various scrapers are available for this purpose, there remains room for improvement. There is a need for a scraper that covers more surface area, without increased effort. There is a need for a scraper that is balanced and provides even contact with the surface to prevent marring and gouging of the surface. There is a need for a scraper that operates in both the forward and reverse stroke, to maximize efficiency. There is a need for a scraper that can be operated with only one hand. Finally, there is a need for such a scraper that can be easily and quickly sharpened on a sheet of emery paper on a flat surface or on a belt sander. These and other advantages are provided by the present invention.

SUMMARY OF THE INVENTION

The present invention comprises a scraper for scraping a planar work surface. The scraper comprises a handle with a first end, a second end and an elongate gripping portion extending therebetween. A first head is provided on the first end of the handle, and a second head is provided on the second end of the handle. First and second blades are supported on the first head, and first and second blades are supported on the second head. The first blades on the first and second heads are angled in a first direction relative to the work surface for scraping the work surface when the scraper is operated in a first direction, and the second blades on the first and second heads are angled in a second direction relative to the work surface for scraping the work surface when the scraper is operated in a second direction opposite the first direction.

The present invention further comprises a paint scraper with a handle having a first end and an elongate gripping portion extending therefrom. A first head is supported on the first end of the handle, and first and second blades are supported on the first head. The first blade on the first head is angled in a first direction relative to the work surface for scraping the work surface when the scraper is operated in a first direction, and the second blade on the first head is angled in a second direction relative to the work surface for scraping the work surface when the scraper is operated in a second direction opposite the first direction. The handle and the first head are relatively positioned so that when the tool is in use the length of the elongate gripping portion is generally parallel to the plane of the work surface.

DETAILED DESCRIPTION OF THE PREFERRED EMBODIMENT

Figure 1:
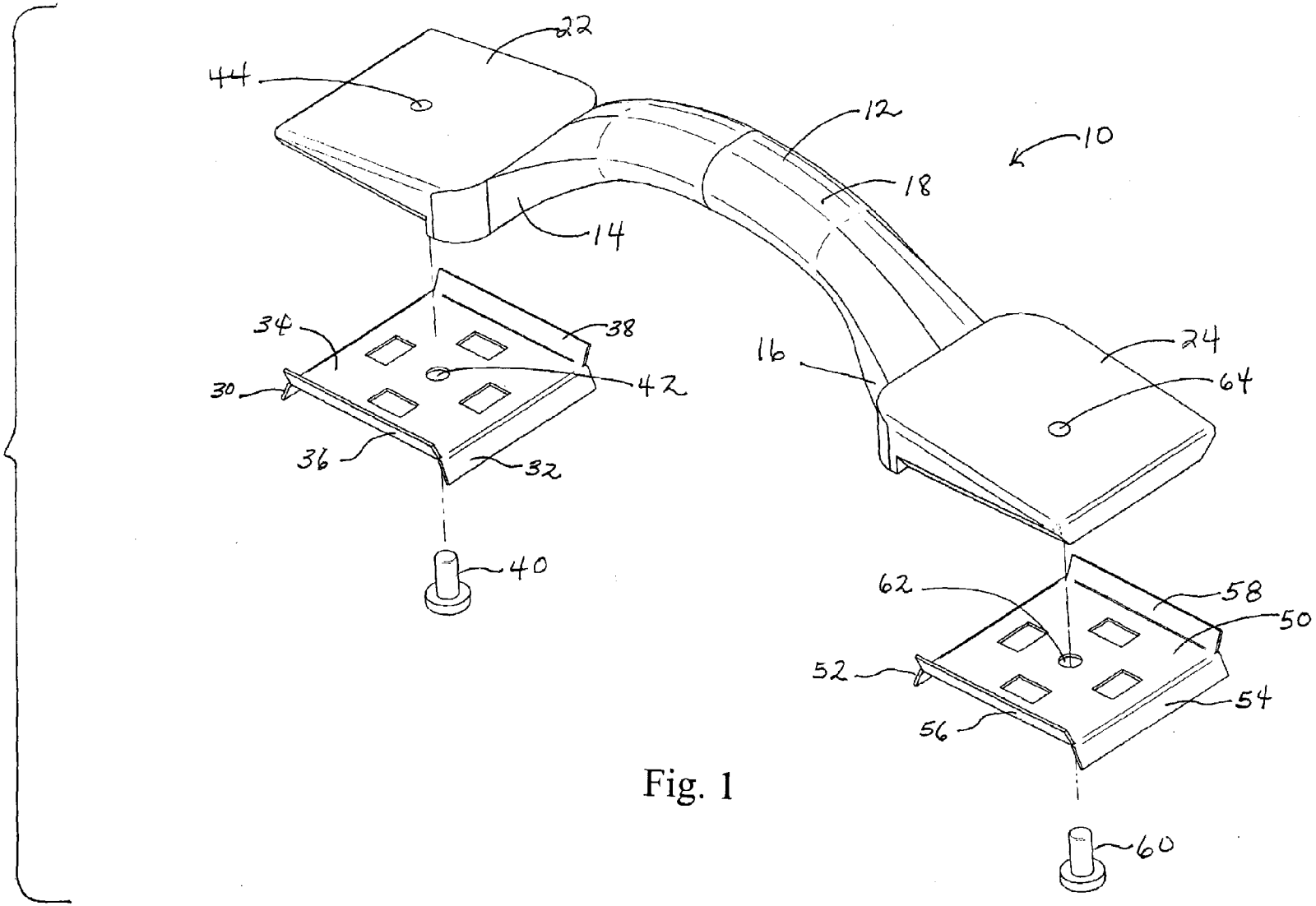
FIG. 1 is an exploded, perspective view of a paint scraper constructed in accordance with the present invention.
Figure 2:
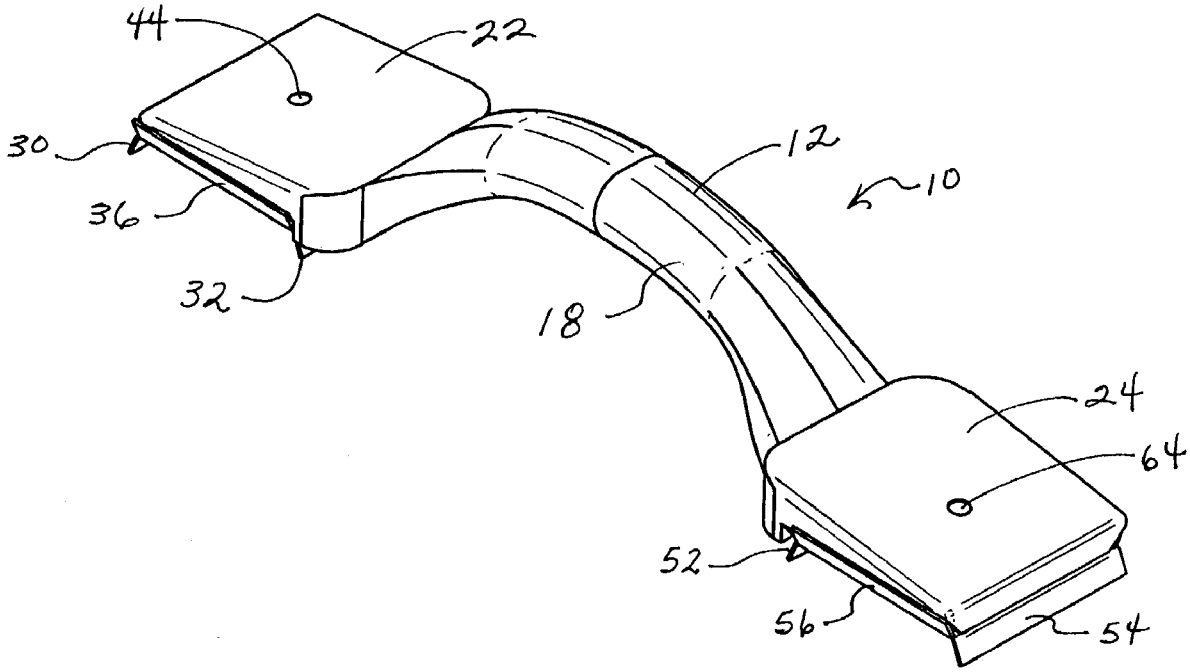
FIG. 2 is a perspective view of the paint scraper of FIG. 1 in assembled form.

With reference now to the FIGS. 1–6 of the drawings, there is shown therein a paint scraper constructed in accordance with a preferred embodiment of the present invention and designated generally by the reference numeral 10. The paint scraper 10 is adapted for scraping paint or other coatings or films off a planar surface of a work piece (not shown). For example, this tool is ideal for scraping loose paint from the wooden siding or trim of a house in preparation for repainting.

Figure 3:
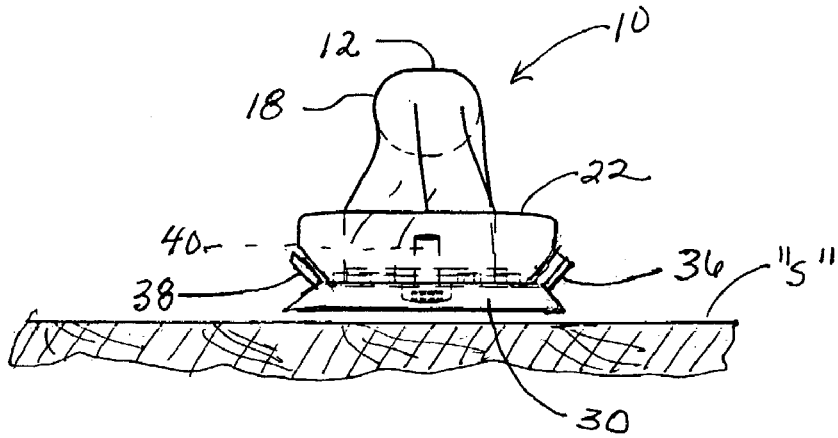
FIG. 3 is an end elevational view of the paint scraper of FIG. 1.
Figure 4:
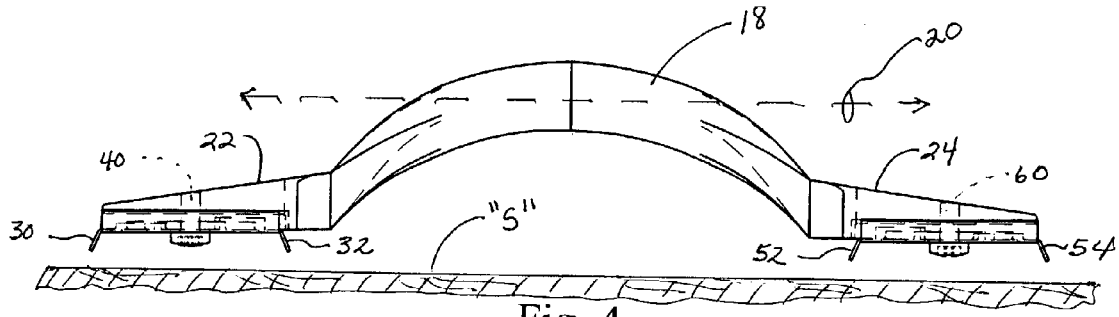
FIG. 4 is a side elevational view of the paint scraper of FIG. 1.
Figure 5:
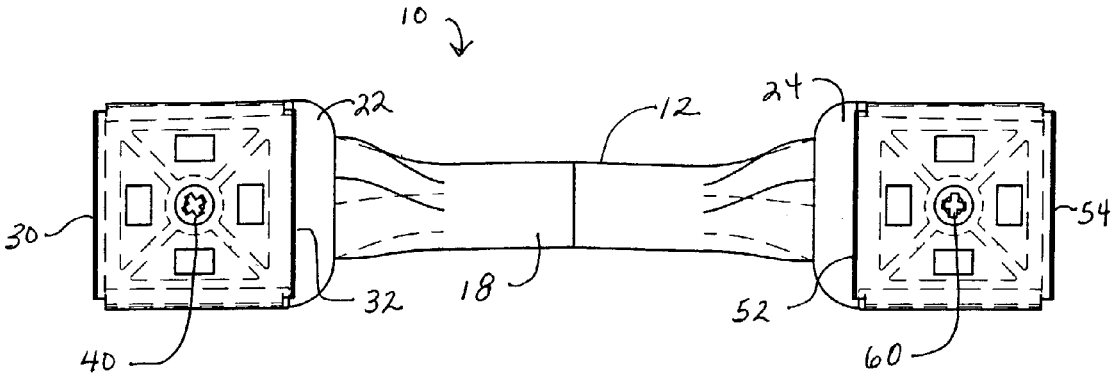
FIG. 5 is a bottom view of the paint scraper of FIG. 1.
Figure 6:
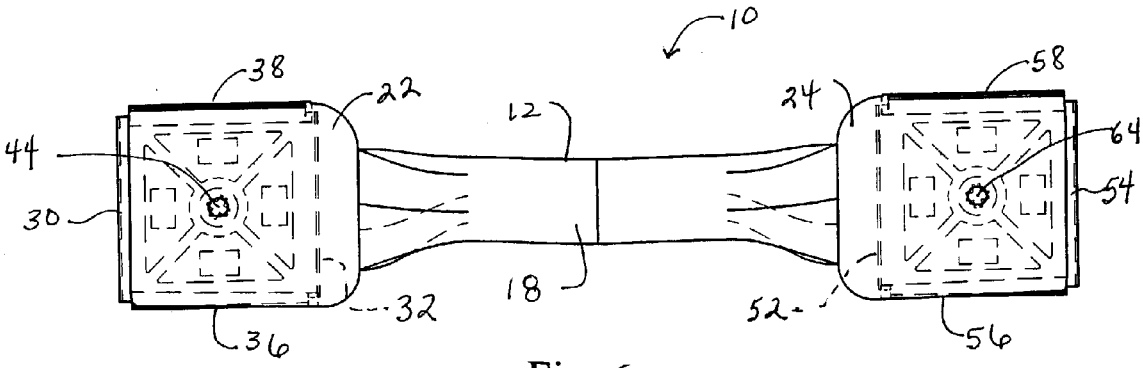
FIG. 6 is a plan view of the paint scraper of FIG. 1.

As shown in FIGS. 1–6, the scraper comprises a handle 12 having a first end 14 and preferably a second end 16. The handle 12 defines an elongate gripping portion 18 extending from the first end 14 and preferably between the first end and the second end 16. Preferably, as illustrated in FIG. 4, the handle 12 is formed so that when the scraper 10 is in use, the length or longitudinal axis 20 of the gripping portion 18 is generally parallel to the plane of the work surface "S".

A first head 22 is supported on the first end 14, and a second head 24 is supported on the second end 16. The heads 22 and 24 may be integrally formed with the handle 12. For example, the heads 22 and 24 and handle 12 may be injection molded from a suitable plastic composition.

First and second blades 30 and 32 are attached to the first head 22. In the preferred practice, the blades are part of a blade plate 34 comprising two pairs of opposing blades including the blades 30 and 32. The two pairs are oppositely oriented so that one pair of blades 36 and 38 extend upwardly on the side of the head 22, as best seen in the perspective view of FIG. 2 and the end view of FIG. 3, while the other pair of blades 30 and 32 extends downwardly in an operating position. The blade plate 34 is attachable to the head 22 by a screw 40 extendable through an opening 42 in the blade plate 34 and engageable in a threaded bore 44 in the first head 22.

In the preferred design, the second head 24 is similarly equipped with a blade plate 50 comprising a first pair of blades, including first and second blades 52 and 54, and a second pair of blades 56 and 58. The blades 52 and 54 are directed downwardly and the blades 56 and 58 directed upwardly. A screw 60 extends through the opening 62 in the plate 50 and engages the internally threaded bore 64 in the second head 24.

The blades 30 and 32 on the first head 22 and the blades 52 and 54 on the second head 24 are supported by the handle so that their scraping edges are all aligned. That is, all the downwardly extending blades are positioned to contact the work surface simultaneously.

In this preferred embodiment, the blades are angled relative to the work surface to facilitate the scraping action. More preferably, opposing blades are oppositely oriented. That is, as seen best in FIG. 4, the blades 30 and 52 are angled in a first direction relative to the work surface for scraping the work surface when the scraper is operated in a first or forward direction. Conversely, the blades 32 and 54 are angled in a second or opposite direction relative to the work surface for scraping the work surface when the scraper is operated in a second direction opposite to the first direction, or a reverse direction.

Thus, the blades 30 and 52 both scrapingly engage the work surface as the scraper is pushed forwardly. Similarly, the blades 32 and 54 both scrapingly engage the work surface as the scraper is pushed in the reverse direction. Because the two similarly angled blades 30 and 52, or 32 and 54, are spaced a distance apart, the surface area covered by a single stroke of the scraper is approximately doubled. Twice as much surface is covered with each stroke.

It will be appreciated that in most instances the blades will be provided with a beveled edge to enhance the scraping function. In addition, as best seen in FIG. 3, the scraping edge of each blade preferably is straight so that the entire edge contacts the work surface evenly. This makes the scraper more stable, promotes even strokes and discourages gouging of the surface. Still further, it is most advantageous if the blade edges are substantially rigid so as to resist deformation during operation of the scraper. That is, the preferred blades are so rigid that they will not deform as the scraper is moved in either direction.

It will be noted that in this preferred design, the blades are removable, as shown in FIG. 1. Indeed, the blade plates make a second set of blades readily available; the user can switch from one set to the other by simply removing each plate, rotating it 90 degrees, flipping it over and reattaching it.

Now it will be apparent that present invention provides a scraper with two oppositely oriented blades on a single head, and in its most preferred embodiment provides two scraper heads, each with a pair of oppositely oriented blades. With the gripping portion of the handle extending lengthwise between the two heads, the scraper provides two spaced-apart blades which operate together in each direction. All the blades are rigid, and straight, providing even, unyielding contact with the work surface for improved scraping action and stable handling. This scraper can be operated with only one hand, and will accomplish twice the work. Moreover, because the edges of all the blades are aligned, all the blades can be sharpened on a sheet of emery paper on a flat surface or on a belt sander.

Changes can be made in the combination and arrangement of the various parts and elements described herein without departing from the spirit and scope of the invention as defined in the following claims.

What is claimed is:

1. A scraper for scraping a planar work surface, the scraper comprising:

an elongated handle having a first end and a second end and being curved along its length to define an elongate gripping portion extending therebetween that is laterally spaced from said ends to define a concavity therebetween;

a first head fixed on the first end of the handle;

a second head fixed on the second end of the handle, said heads being longitudinally spaced from one another;

first and second blade plates mounted to the first and second heads respectively, each blade plate having first and second downwardly extending blades thereon;

wherein the first blades on the first and second plates are angled in a first, same direction with respect to one another and relative to the work surface for scraping the work surface when the scraper is operated in a first direction; and wherein the second blades on the first and second plates are angled in a second same direction with respect to one another and relative to the work surface for scraping the work surface when the scraper is operated in a second direction opposite the first direction, said first and second directions are opposite one another relative the work surface.

2. The scraper of claim 1 wherein the first and second blades on the first and second heads are removable.

3. The scraper of claim 2 wherein the handle and the first and second heads are relatively positioned so that when the tool is in use the length of the elongate gripping portion is generally parallel to the plane of the work surface.

4. The scraper of claim 1 wherein the first and second blades on the first and second heads are sufficiently rigid to resist deformation during operation of the scraper in the first and second directions.

5. The scraper of claim 1 wherein the first and second blades on the first and second heads are beveled.

6. The scraper of claim 1 wherein the handle and first and second heads are integrally formed.

7. The scraper of claim 6 wherein the first and second blades on the first and second heads are removable, wherein the first and second blades on the first and second heads are sufficient rigid to resist deformation during operation of the scraper in the first and second directions, and wherein the first and second blades on the first and second heads are beveled.

* * * * *